United States Patent [19]

Van de Caveye

[11] 4,321,028

[45] Mar. 23, 1982

[54] CONCRETE MOLDING APPARATUS INCLUDING RECIPROCATING BELT FEEDER

[75] Inventor: Yves H. Van de Caveye, Beauvais, France

[73] Assignee: Societe d'Exploitation des Establishments Minato, France

[21] Appl. No.: 177,060

[22] Filed: Aug. 11, 1980

[30] Foreign Application Priority Data

Aug. 9, 1979 [FR] France ..... 79 20373

[51] Int. Cl.[3] ..... B28B 1/08; B28B 1/04

[52] U.S. Cl. ..... 425/217; 198/580; 222/318; 425/225; 425/229; 425/256; 425/424; 425/432; 425/DIG. 116

[58] Field of Search ..... 425/256, 258, 225, 228, 425/230, 218, 219, 253, 254, 255, 351, 421, 428, 422, 416, 351, 457, 215–217, 230, 431, 432, 456, 223, 145, 148, 226, 227, 229, 424, 412, DIG. 116; 198/580, 631, 499, 497, 859; 222/318, 342, 404, 408, 415

[56] References Cited

U.S. PATENT DOCUMENTS

| | | | |
|---|---|---|---|
| 2,141,859 | 12/1938 | Green | 198/424 |
| 2,834,484 | 5/1958 | De Vaney et al. | 198/606 |
| 3,127,657 | 4/1964 | Benjey et al. | 425/148 |
| 3,128,522 | 4/1964 | Benjey et al. | 425/444 |
| 3,224,553 | 12/1965 | Campbell | 198/580 |
| 3,630,414 | 12/1971 | Parmentier | 222/415 |
| 4,119,193 | 10/1978 | Smith et al. | 198/631 |

FOREIGN PATENT DOCUMENTS

| | | | |
|---|---|---|---|
| 1266198 | 4/1968 | Fed. Rep. of Germany . | |
| 2209228 | 8/1973 | Fed. Rep. of Germany . | |
| 1591141 | 4/1970 | France . | |
| 2050485 | 4/1971 | France . | |
| 1279810 | 6/1972 | United Kingdom | 425/456 |

*Primary Examiner*—Willard E. Hoag
*Attorney, Agent, or Firm*—Steinberg & Raskin

[57] ABSTRACT

A press for molding concrete products comprising a vibrating table, a mold adapted to be put on the vibrating table and to be filled with concrete, a concrete feeding means such as a hopper and means provided between the hopper and the mold to fill the mold with a given amount of concrete, said mold filling means comprising an endless belt conveyor arranged below the hopper and including belt-driving means, and means for bodily displacing the conveyor in a linear reciprocating motion so as to move the forward end of the conveyor above the mold and to bring it back to an initial position.

14 Claims, 4 Drawing Figures

CONCRETE MOLDING APPARATUS INCLUDING RECIPROCATING BELT FEEDER

The invention relates generally to a press for moulding or casting products made from concrete, such as concrete blocks or the like, which comprises in particular an improved concrete feeding device for the moulding or casting of such products.

Such presses for moulding concrete products are will known in the prior state of the art and they generally comprise a vibrating table, a mould selectively displaceable vertically by means of jacks or like power actuators, for being laid down onto the vibrating table and filled with concrete, a tamper or rammer for tamping or compacting the concrete within the mould and stripping or releasing the castings by lifting the mould, and a concrete feeding device comprising a hopper or bin associated with a filling slide member driven back and forth underneath the hopper or bin for filling the mould.

This filling slide member used in the prior state of the art gives rise to a number of difficulties and is of little convenient use. Indeed the control jacks or power actuators operating the displacement of the slide member are undergoing hydraulic reactions called water hammer in operation of the slide member and the hydraulic control circuits are affected thereby and have their life thus shortened. There also are problems of sealing and fluid-tightness on the periphery of the slide member, a relatively quick wear of the slide member and of the top face of the mould, a transmission of mechanical shocks and impacts generating substantial noise, the necessity of often cleaning this filling slide member. Further it is necessary when changing the mould and using a mould of a different height to correspondingly adjust the position in height of the slide member.

The object of the present invention is to avoid all these inconveniences and for this purpose it provides a press for moulding concrete products, comprising a vibrating table, a mould adapted to be put on the vibrating table and to be filled with concrete, a concrete feeding means such as a hopper or bin and means provided between this hopper and the mould to fill the latter with a predetermined amount of concrete, wherein the improvement consists in that the mould filling means comprise an endless belt conveyor arranged below the hopper and including means for driving the belt in a predetermined direction and means for bodily displacing the conveyor in linear reciprocating motion so as to pass the forward end of the conveyor above the mould and to bring it back to an initial position.

According to another characterizing feature of the invention, the conveyor is arranged at a stationary height within the press.

It is easily understandable that the concrete put on the endless belt of the conveyor is fed by this endless belt into the mould when the belt is moving and that it is no longer necessary to adjust the height of the belt or of the conveyor in accordance with the height of the mould, the concrete carried by the belt falling or dropping into the mould.

It is also easily understandable that thereby are avoided all the difficulties and inconveniences which were inherent with the use of a filling slide member.

According to a further characterizing feature of the invention this press also comprises means for recycling excess concrete after scraping or wiping off the top of the upper edge of the mould and of the endless belt.

According to a first embodiment these recycling means comprise a chute or spout for receiving the concrete srapings and means such as an endless or worm or Archimedean screw for bringing the scrapings collected or gathered in the chute or spout back to the endless belt of the conveyor into an area directly located before or upstream of the concrete feed hopper so that the recycled concrete discharged onto the belt be covered by the concrete issuing from the feed hopper during the following mould filling cycle.

Such a recycling device however suffers from inconveniences inherent with the use of an endless or worm screw. As a matter of fact the concrete scrapings are likely to be jammed between the endless screw and the tubular casing or housing in which this endless screw is accommodated. Otherwise stated such a recycling device is therefore not of a great effectiveness or of a great reliability in particular on account of friction and jamming difficulties generated during the displacement of the concrete scrapings.

The recycling device according to a second embodiment of the invention aims at coping with the drawbacks of the endless screw recycling device by removing any jamming and frictional problems likely to occur between the concrete scrapings and the means for carrying them along, and is characterized and that it consists:

of a vibrating trough or channel conveyor which receives toward one of its ends the concrete scrapings and carries them to its other opposite end and of a conveyor band with endless belts which in turn is receiving the concrete scrapings for delivering them onto the endless belt of the mould filling conveyor within an area directly positioned before or upstream of the concrete feed hopper.

According to another characterizing feature of this recycling device, the vibrating conveyor trough or channel exhibits two guiding side walls and has a width decreasing in the direction of travel of the concrete scrapings, said width having its largest size at its end adjacent to the mould and its smallest size at its end adjacent to the conveyor band.

According to a further characterizing feature of this recycling device the conveyor band consists of a first endless belt on which are freely falling the concrete scrapings at the outlet of the vibrating conveyor trough and of the second endless belt which is then covering or overlapping the first endless belt for confining or holding back the concrete scrapings while they are carried along towards the endless belt of the mould filling conveyor located at a higher level of the press than the vibrating trough conveyor.

The invention will be better understood and further objects, characterizing features, details and advantages thereof will appear more clearly as the following explanatory description proceeds with reference to the accompanying diagrammatic drawings given by way of non-limiting example only illustrating a presently preferred specific embodiment of the invention and wherein.

Figure 1:
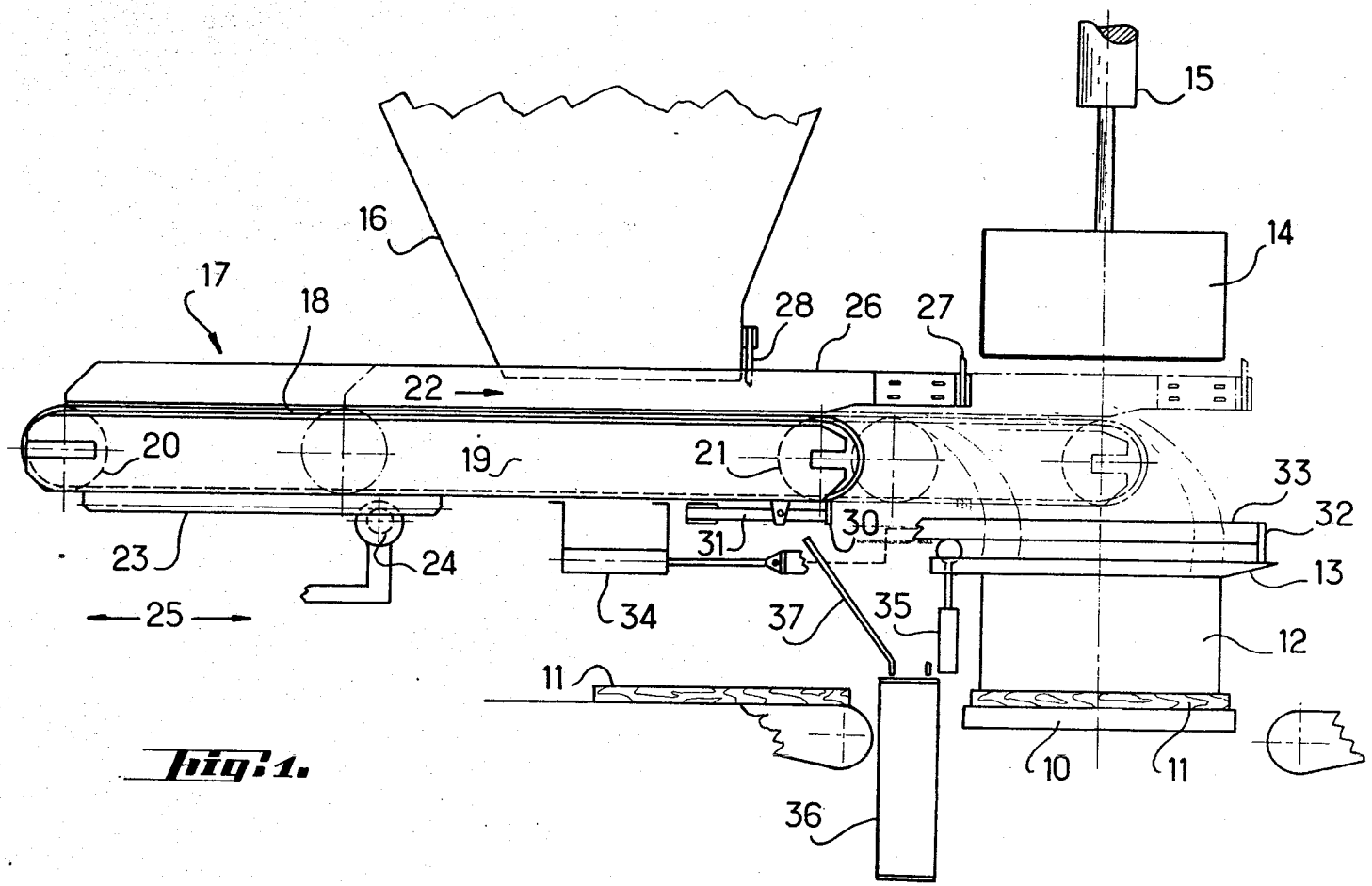
FIG. 1 is a partial diagrammatic view of a filling press comprising a feed device according to the invention.

The press which has been shown very diagrammatically in FIG. 1 comprises as known per se a vibrating table 10 which supports a board 11 made from wood or any other suitable material and adapted to receive the moulded concrete product. In the moulding position a mould 12 is lowered or moved downwards by means of hydraulically powered ram actuators or like jacks not shown, onto the board 11. At its upper portion the mould 12 comprises a flange or ledge 13 shaped as shown in the drawings.

Above the mould is provided a tamper or like rammer 14 movable according to a vertical linear reciprocating motion by means of hydraulically operated jacks or like power actuators 15.

In the mould filling position the tamper 14 is raised above the mould and also above means for filling the mould with concrete, which will be described hereinafter. The means for feeding the press with concrete comprise a hopper or bin 16 arranged in a stationary position on the framework and adapted to hold a certain amount of concrete.

Underneath the hopper 16 is provided a conveyor 17 with an endless belt 18. The conveyor 17 essentially comprises a frame 19 carrying at its rear end a drive roll 20 for moving the endless belt and at its forward end a loose or idle roll 21 over which the belt 18 is reeved or passing. It may thus be appreciated that the rolls 20 and 21 are providing for the advancing motion of the upper side or strand of the endless belt 18 in the direction shown by the arrow 22.

The frame 19 of the conveyor 17 also includes for instance on its rear bottom part a rack 23 arranged in a stationary position on the frame and which is engaged by or meshing with a drive gear 24 operated by any suitable means not shown. The gear 24—rack 23 system enables the conveyor 17 to be bodily displaced according to a linear reciprocating motion in both opposite directions shown by the arrows 25.

In the position shown in solid lines on FIG. 1, the conveyor is in its rear position whereas in the position shown in broken or chain-dotted lines it is in its most advanced position, an intermediate position being shown in phantom lines.

The frame 19 of conveyor 17 also carries a pair of guiding side walls 26 which extend lengthwise with respect to the frame on either side of the upper strand of the endless belt 18 and which serve the purpose of defining the width of the concrete layer discharged by the hopper 16 onto the top portion or upper side of the endless belt 18.

These guiding side walls 26 also carry at their end a scraper, wiper or like doctor 27 which is adapted to scrape the bottom face of the tamper 14 with a view to cleaning same when the latter is in the upper or lifted position shown in the drawing.

A damper or like gating means 28 is also provided above the conveying belt 18 and is for instance secured onto the forward side of the hopper 16 for adjusting the concrete layer discharged onto the belt 18.

It is thus appreciated that the amount of concrete which will be poured or cast by the endless belt 18 into the mould 12 is determined on the one hand in its side dimension and height or thickness by the side walls 26 and by the damper or gate 28 and on the other hand in its longitudinal dimension by the speed of travel of the endless belt 18 about the rolls 20 and 21 and by the velocity of motion of the conveyor 17 driven by the drive gear 24 meshing with the rack 23.

The press shown on FIG. 1 moreover comprises means for cleaning the endless belt 18 and means for scraping or wiping the upper part 13 of the mould 12.

The means for cleaning the endless belt 18 comprise a scraper, wiper or like doctor 30 provided below the front roll 21 and arranged endwise of a lever 31 pivotally connected at an intermediate point or fulcrum thereof to the frame 19 and for instance provided with a counterweight at its free end.

The means for scraping the top edge or rim 13 of the mould 12 comprise a scraper 32 supported by a frame or arms 33. The frame 33 and the scraper 32 are displaced according to a horizontal linear motion by means of a power jack or like ram actuator 34 carried by the machine frame and according to a pivoting or swinging motion in a vertical plane by means of a lifting jack or a like ram actuator 35.

On FIG. 1 the scraper 32 and the frame 33 have been shown in their forward end positions. They may be moved backwards of the mould by means of the power jack or like ram actuator 34. The jack 35 provides for the lifting of the scraper 34 during its advancing motion and then moves downwards again for allowing it to rest on the edge 13 of the mould during its return motion towards the jack 34. The lifting jack 35 provides also for adjusting the position of the scraper 32 in height for adapting same to the various mould heights used.

Such a device according to a first embodiment also comprises a chute or spout 36 for receiving the concrete scrapings carried along by the scraper 32 and also the concrete scrapings removed from the endless belt 18 by the scraper 30. These concrete scrapings are guided into the chute or spout 36 by the inclined plane 37.

Figure 2:
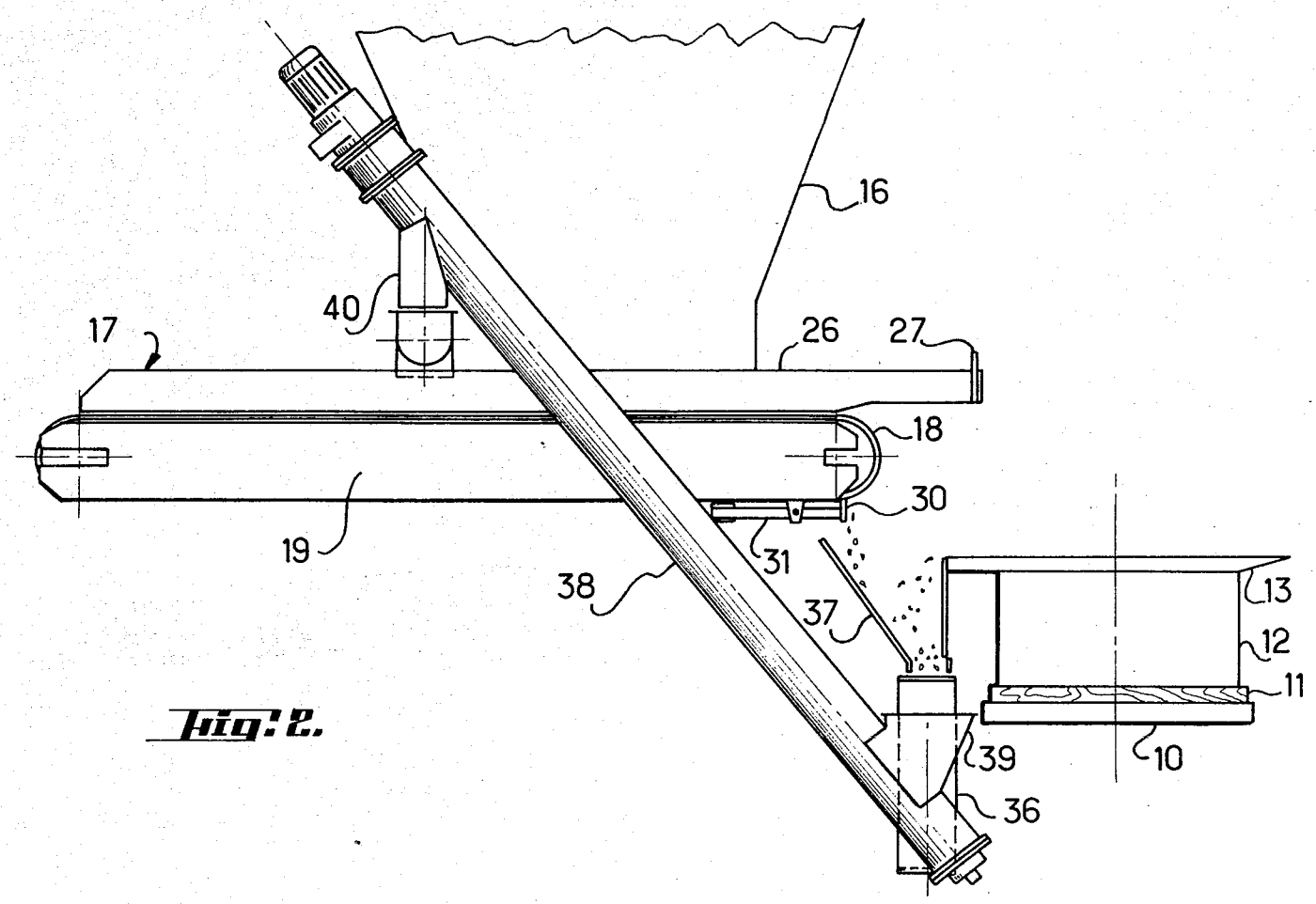
FIG. 2 is a partial diagrammatic view showing the same press which includes means for recycling the concrete scrapings, according to a first embodiment.

As shown in FIG. 2, the chute or spout 36 is associated with means for recycling the concrete scrapings which comprise for instance an endless screw accommodated within a tubular casing or a housing 38 arranged in a sloping position between the chute 36 and the conveyor 17. The chute 36 is communicating with the lower portion of the tube 38 through a duct 39 whereas the upper portion of the tube 38 is provided with a discharge or dumping duct 40 for delivering the concrete scrapings carried along upwards of the tube 38 by the endless screw onto the endless belt 18 directly ahead of the location of the hopper 16. In this manner the concrete scrapings gathered or collected and discharged onto the endless belt 18 will be covered with fresh concrete issuing from the hopper 16 during the following mould filling cycle. With this arrangement an intimate mixture between the fresh concrete the concrete scrapings is achieved and this would not necessarily be obtained if the concrete scrapings were directly returned into the hopper 16.

Figure 3:
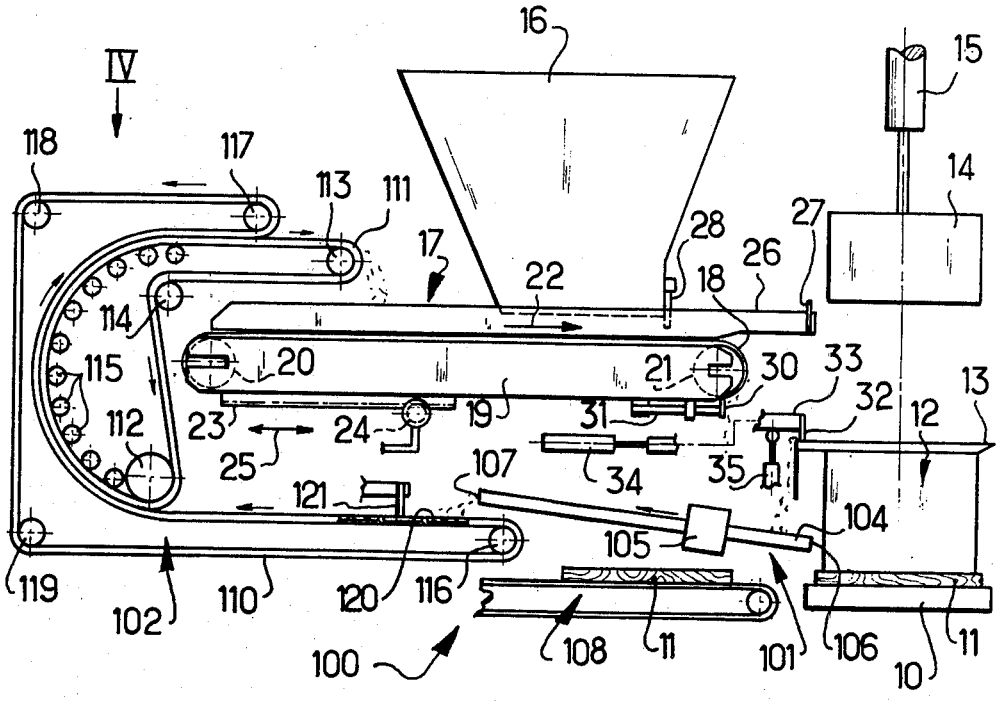
FIG. 3 is a partial diagrammatic view showing the same press with means for recycling the concrete scrapings according to a second embodiment.
Figure 4:
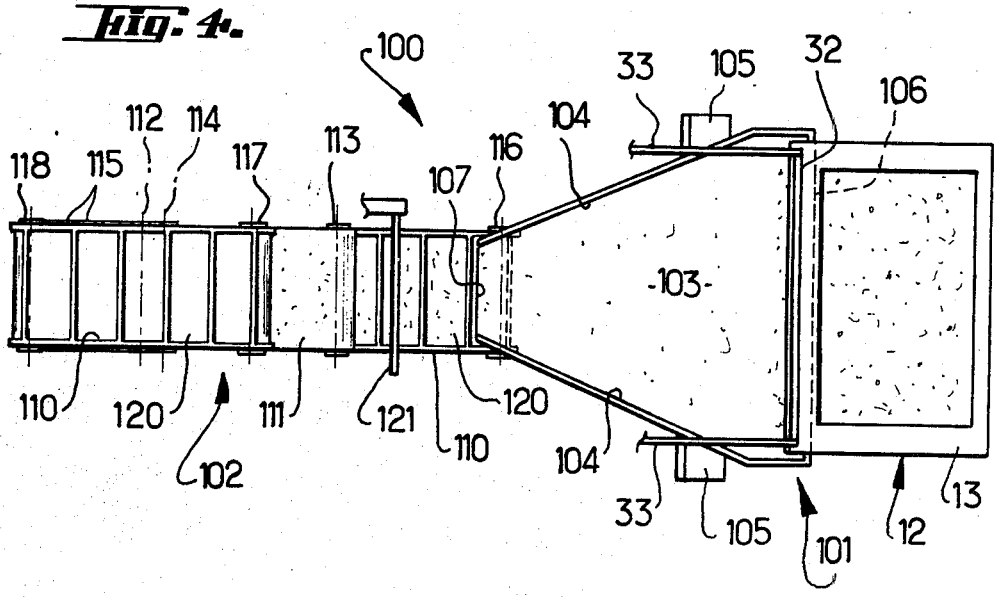
FIG. 4 is a top view looking in the direction of the arrow IV of FIG. 3.

Referring to FIGS. 3 and 4, the recycling device 100 according to a second embodiment of the invention consists of a vibrating conveyor trough or channel 101 and of a conveyor band 102 with endless belts.

The vibrating conveyor trough 101 consists of a plate 103 of elongated shape edged sidewise with two guide walls 104. On each one of the sides of this conveyor trough 101 is provided a vibrating contrivance 105 known per se.

The end 106 of the plate extends over a width corresponding at least to the width of the mould 12 whereas its other end 107 extends over a lesser width corresponding substantially to the width of the conveying band 102. In other words both guiding side walls 104 of the plate are tapering with respect to the longitudinal center line axis of this plate and arranged in symmetrical relationship with respect to this axis.

This conveyor trough 101 is arranged within the press at a level intermediate between the level where is located the vibrating table 10 and the level where is positioned the conveyor 17 and is mounted as an inclined plane with its widest end 106 located on a lower level with respect to the level of its other end 107. More specifically the end 106 of the plate 103 should be located on a level lower than the level reached by the top surface of the smallest mould 12 likely to be used so as to make sure that the scraped concrete will fall or drop in any case through its own weight onto the plate 103. This end 106 of the plate 103 is adjacent or in close proximity to that side wall of the mould 12 which extends at right angles to the conveyor 17 and adjacent to the latter when the same is in its rearward position shown on FIG. 1.

This particular arrangement of the conveyor trough 101 is mainly due to the provision of the conveyor 108 which provides for the transfer or carriage of the boards 11 towards the vibrating table 10, said conveyor 108 being arranged in parallel relation to the conveyor 17. Under such circumstances the vibrating conveyor trough 101 is provided within the space defined by both conveyors 17 and 108.

The conveyor band 102 consists of two endless belts 110, 111. The endless belt 111 is winding about and reeved over two lower and upper end rolls 112, 113, respectively. With respect to the rearward position of the conveyor 17 such as shown on FIG. 1, the rolls 112 and 113 are located below and above the conveyor 17, respectively. The roll 112 is positioned slightly beyond the roll 20 of the conveyor 17 in a direction opposite to the direction 22 of motion of the conveyor 17 whereas the roll 113 lies between the roll 20 of the conveyor 17 and the hopper 16. To pass from the roll 112 to the roll 113, the endless belt 111 extends over an intermediate roll 114 located slightly above the conveyor 17 so as to enable the belt 111 to wind or pass round the conveyor 17 when the latter is in its rearward position. To pass from the roll 113 to the roll 112, the endless belt 111 will pass over a series of intermediate rolls 115 arranged substantially along an arc of circumference.

The endless belt 110 is wound round or reeved over two lower and upper end rolls 116, 117, respectively. The roll 116 is located underneath the end 107 of the vibrating conveyor trough 101 so that the belt 110 receives the concrete scrapings falling down from this end 107 of the vibrating conveyor trough 101. The roll 117 is positioned above the roll 113 of the endless belt 111 between the auxiliary roll 114 and the upper roll 113 associated with the endless belt 111. The endless belt 110 passes from the roll 116 to the roll 117 while bearing onto the roll 112 and the auxiliary rolls 115 of the endless belt 111. Then the endless belt 110 extends back from the roll 117 to the roll 116 through the agency of a pair of auxiliary rolls 118, 119. Under such circumstances both outer and inner endless belts 110 and 111, respectively, are engaging with each other over a common path of travel defined by the roll 112, the auxiliary rolls 115 and the roll 117. It should be understood that the shafts or axes of all of the aforesaid rolls are extending in parallel relationship with each other and at right angles to the direction of displacement of the conveyor 17.

Referring to FIG. 4, the surface of the endless belt 110 adapted to receive the concrete scrapings may be formed with successive pockets or compartments 120 to provide for a better carriage of the concrete scrapings.

In order to adjust the height or thickness of the concrete scraping carried along by the endless belt 110 it may be advantageous to provide a scraper or like wiper or doctor 121 arranged across the endless belt 110 and slightly beyond that area of the endless belt 110 where the concrete scrapings are falling down.

The press previously described operates as follows:

When the conveyor 17 is in the position shown in solid lines in the drawings and when a mould 12 is lowered onto the vibrating table 10 while being supported or bearing on the board 11, the tamper 14 being in the raised position shown in FIG. 1, it is only necessary to operate the driving of the endless belt 18 in the direction shown by the arrow 22 and to operate the displacement of the conveyor 17 by means of the gear 24 and the rack 23 so as to cause it to advance to its endmost forward position shown in broken or chain-dotted lines in FIG. 1. With the endless belt 18 driven in the direction of the arrow 22, the concrete is caused to be discharged over the whole surface of the mould during the travel of the conveyor 17 as diagrammatically shown on FIG. 1. The filling of the mould may be carried out either during the forward motion and the backward motion of the conveyor 17 or only during the forward motion of the conveyor 17. The speed of travel of the endless belt 18 may be steady or continuously variable if desired. It will be appreciated that the velocity of the endless belt 18 and the speed of travel of the conveyor 17 are adjusted so that when the endless belt 18 is stopped and when accordingly the discharge of concrete into the mould 12 is discontinued the latter is filled with a slight excess amount of concrete.

When the filling of the mould has been completed the scraper 32 is moved forward above the mould but without engaging same, by the jack 34 and then the lowering of the scraper 32 down onto the edge 13 of the mould is operated by means of the jack 35 and then the scraper is returned to its rearward position by means of the jack 34. The scraped concrete will then fall down into the chute or spout 36 together with the concrete which has been scraped off the endless belt 18 by the scraper 30 and it is recycled by being returned onto the endless belt 18 in the aforesaid manner by means of the endless screw housed within the tubular case 38.

Afterwards the tamper 14 is moved downwards onto the mould 12 on the one hand to adjust the concrete to a constant height within the mould 12 and on the other hand to enable the moulded product or casting to be stripped off or released when the mould 12 is lifted. The tamper 14 is eventually raised and brought back to its initial position shown and then the board 11 supporting the moulded product or casting is carried away and replaced by a new board 11.

The continuous recycling device according to the second embodiment is working as follows (FIGS. 3, 4).

When the filling of the mould 12 has been completed the scraper 32 which is co-operating with the top edge 13 of the mould will carry the scraped concrete by making it fall down onto the vibrating conveyor trough 101 in the vicinity of its end 106 adajcent to the mould 12. The vibrators 105 will impart to the vibrating trough 101 suitable vibrations so as to carry the concrete scrapings along from the end 106 to the end 107 of the trough, the concrete scrapings moving upwards the inclined plane provided by the plate 103 of the conveyor trough 101. Then the scrapings will freely fall down onto the endless belt 110 of the conveyor band 102. In the vicinity of the rolls 112 the endless belt 111 will overlie the belt 110 to hold back or confine the concrete scrapings and provide for their conveyance to an upper level of the press in order to return them onto the endless belt 18 of the conveyor 17. The concrete scraped off by the scraper 30 associated with the endless belt 18 of the conveyor 17 is also continuously recycled along the same path of travel, these scrapings falling directly down onto the vibrating conveyor trough 101.

It is obvious that many modifications may be made to the embodiments described and shown within the scope of the invention. Likewise the control or operation of the advancing motion of the endless belt 118 and of the displacement of the conveyor 17 may be carried out by any suitable means.

It should also be understood that one of the essential advantages of the invention is the omission of the feeding slide member which was previously used in the known state of prior art.

It should be understood that the invention is not at all limited to the embodiment described and shown which have been given by a way of illustrative examples only. In particular it comprise all the means constituting technical equivalents of the means described as well as their combinations if same are carried out according to its gist and used within the scope of the appended claims.

What is claimed is:

1. A press for moulding concrete products, comprising a vibrating table, a mould adapted to be put onto the vibrating table and to be filled with concrete, a concrete feed means such as a hopper and means provided between said hopper and said mould to fill said mould with a predetermined amount of concrete, wherein the improvement consists in that the mould filling means comprise an endless belt conveyor arranged below said hopper and including means for driving said belt in a predetermined direction, means for bodily displacing said conveyor according to a linear reciprocating motion so as to pass the forward end of said conveyor above said mould and bring it back to an initial position; and means for cleaning the top of said mold attached to reciprocal means supporting the conveyor.

2. A press for moulding concrete products, comprising a vibrating table, a mould adapted to be put onto the vibrating table and to be filled with concrete, a concrete feed means such as a hopper and means provided between said hopper and said mould to fill said mould with a predetermined amount of concrete, wherein the improvement consists in that the mould filling means comprise an endless belt conveyor arranged below said hopper and including means for driving said belt in a predetermined direction and means for bodily displacing said conveyor according to a linear reciprocating motion so as to pass the forward end of said conveyor above said mould and bring it back to an initial position, said conveyor being reciprocal a distance such that the conveyor discharge end can be moved to a position horizontally spaced from the mould and over recycle means, said recycle means being part of said apparatus.

3. A press according to claim 2, wherein said conveyor is arranged at a stationary height within said press.

4. A press according to claim 2, wherein said mould filling means comprises means for adjusting the thickness of the concrete layer discharged onto said endless belt, said means comprising in particular a stationary damper provided at a certain height above said belt.

5. A press according to claim 2, wherein said conveyor comprises a belt-supporting frame, a belt-driving power roll mounted at one end of said frame, a loose roll mounted at the other end of said frame, two guiding side walls extending lengthwise on the upper part of said frame on either side of said endless belt, said means for moving said conveyor above said mould including in particular a rack secured to said frame and a drive gear meshing with said rack.

6. A press according to claim 5, wherein the rotating speed of said belt-driving power roll is adjusted and controlled, said speed being either steady during the displacement of said conveyor or continuously variable.

7. A press according to claim 2, wherein said mould filling means comprises a scraper mounted on the conveyor frame for cleaning the endless belt of the conveyor.

8. A press according to claim 7, and comprising a tamper adapted to be selectively lowered onto the concrete filling said mould for adjusting said concrete within said mould to a constant height and for stripping off or releasing the concrete products, wherein said mould filling means further comprises means for recycling the concrete which is not filled into the mould and the concrete which is stripped off said endless belt of the conveyor.

9. A press according to claim 8 wherein said concrete recycling means comprises a scraper for cleaning the bottom face of said tamper, said scraper being mounted at one end of the guiding side walls of said conveyor, and another scraper for cleaning the top edge of said mould, means for receiving and collecting the concrete scrapings produced with said scrapers, and means for carrying said concrete scrapings collected in said receiving means towards said endless belt of said conveyor within an area located directly ahead of said concrete feed hopper so that the recycled concrete discharged onto said belt is covered with concrete issuing from said free hopper during the next mould feeding cycle.

10. A press according to claim 9, wherein said recycling means comprises means for displacing said scraper for cleaning the top edge of said mould according to a reciprocating motion above said mould and means for displacing said scraper according to a pivoting or swinging motion in a vertical plane in accordance with the different heights of said mould.

11. A press according to claim 9, wherein said receiving means of concrete scrapings consists of a receiving chute and said means for carrying scrapings gathered in said chute towards said endless belt consists of an endless screw.

12. A press according to claim 9, wherein said scrapings receiving means consists of a vibrating conveyor trough receiving towards one of its ends said concrete scrapings and providing for their transfer towards its other opposite end, and said scrapings carrying means consists of a conveyor band with endless belt receiving in turn said concrete scrapings to deliver them to said endless belt of said conveyor.

13. A press according to claim 12, wherein said vibrating conveyor trough is fitted with a pair of guiding side walls and exhibits a width decreasing in the direction of travel of said concrete scrapings, said width having its largest size at its end adjacent to said mould and its smallest size at its end adjacent to said conveyor band.

14. A press according to claim 12, wherein said conveyor band consists of a first endless belt onto which said concrete scrapings are falling down and of a second endless belt which is covering in overlapping relationship said first endless belt to confine and hold back said concrete scrapings during their transfer towards the endless belt of said conveyor located on a level of said press which is higher than the level of said vibrating conveyor trough.

* * * * *

UNITED STATES PATENT AND TRADEMARK OFFICE

CERTIFICATE OF CORRECTION

PATENT NO. : 4,321,028

DATED : March 23, 1982

INVENTOR(S) : Yves H. Van de Caveye

It is certified that error appears in the above—identified patent and that said Letters Patent is hereby corrected as shown below:

[73] Assignee: SO. DE. EM. SOCIETE D' EXPLOITATION DES ETABLISSEMENTS MINATO, France

[30] FOREIGN APPLICATION PRIORITY DATA

Aug. 9, 1979 [FR] France ... 79 20373

July 3, 1980 [FR] France ... 80 14825

Signed and Sealed this

Tenth Day of April 1984

[SEAL]

Attest:

GERALD J. MOSSINGHOFF

Attesting Officer

Commissioner of Patents and Trademarks